US006374573B1

(12) United States Patent
String

(10) Patent No.: US 6,374,573 B1
(45) Date of Patent: Apr. 23, 2002

(54) MANUAL COIN WRAPPER CRIMPER

(75) Inventor: Gregory F. String, Mechanicsburg, PA (US)

(73) Assignee: N. F. String & Son, Inc., Harrisburg, PA (US)

( * ) Notice: Subject to any disclaimer, the term of this patent is extended or adjusted under 35 U.S.C. 154(b) by 110 days.

(21) Appl. No.: 09/595,869

(22) Filed: Jun. 16, 2000

(51) Int. Cl.[7] ..... B65B 11/04; B65B 67/08
(52) U.S. Cl. ..... 53/213; 53/372.9
(58) Field of Search ..... 53/212, 213, 372.8, 53/372.9; 493/159, 459

(56) References Cited

U.S. PATENT DOCUMENTS

| | | | | | |
|---|---|---|---|---|---|
| 1,038,361 | A | * | 9/1912 | Hart | 53/212 |
| 1,689,430 | A | * | 10/1928 | Gwinn | 53/372.9 |
| 2,110,685 | A | | 3/1938 | Seemel | 93/5 |
| 2,635,402 | A | * | 4/1953 | Jorgensen | 53/212 |
| 3,373,542 | A | * | 3/1968 | Ikeuchi | 53/212 |
| 3,547,012 | A | | 12/1970 | Amberg et al. | 93/36.5 |
| 4,069,647 | A | | 1/1978 | Horie | 53/212 |
| 4,089,151 | A | | 5/1978 | Bergman et al. | 53/59 R |
| 4,091,599 | A | * | 5/1978 | Lemieux | 53/213 |
| 4,261,157 | A | | 4/1981 | Harbaugh | 53/212 |
| 5,120,294 | A | | 6/1992 | Segars et al. | 493/296 |

* cited by examiner

*Primary Examiner*—John Sipos
(74) *Attorney, Agent, or Firm*—Thomas Hooker, P.C.

(57) ABSTRACT

A crimper for forming a finished crimped end on a wrapper for coins or other articles has a cylindrical opening for receiving a projecting end of the wrapper into the body. A crimping structure located in the opening includes a first slide surface for sliding the end of the wrapper in a first linear direction to a second of slide surface for sliding the end of the wrapper in a second, transverse linear direction. By sliding the end of the wrapper in the two directions, the end of the wrapper is forced to roll and form a finished crimped end.

17 Claims, 3 Drawing Sheets

MANUAL COIN WRAPPER CRIMPER

FIELD OF THE INVENTION

The invention relates to crimping devices used to crimp the ends of paper wrappers or tubes for rolls of coins or other objects.

BACKGROUND OF THE INVENTION

Coin wrappers are paper tubes having a finished crimp at one end of the tube and an opposite open end. Coins are inserted in a wrapper through the open end of the tube to form a stack of coins. The coin stack abuts the-crimped end of the wrapper to prevent the coins from falling out the wrapper as the wrapper is being filled.

A coin wrapper is designed to hold a specific number of coins of like denomination. When the coin wrapper is filled, the open end of the tube projects beyond the coin stack. The projecting wrapper portion is then manually folded over the coin stack to secure the coin stack in the wrapper.

Many coin collectors dislike the appearance of coin wrappers having a manually folded end. These collectors would prefer that both ends of the wrapper have finished crimped ends.

Powered crimping machines are available to crimp the projecting ends of coin wrappers. Such machines include a rotary head typically holding one or more pair of concave, "J"-shaped hooks. The head rotates the hooks about the projecting end of the wrapper and presses the hooks against the end of the wrapper. The concave surface of each hook defines a curved sliding surface. The end of the wrapper slides on these concave surfaces and is rolled over to form a finished crimp.

Powered crimping machines are too expensive for most coin collectors. A rotary head must be purchased for each denomination of coin wrapper, and the curved slide surfaces of the hooks are expensive to manufacture. The machines require periodic maintenance and can be expensive to repair.

Thus, there is a need for an improved device for crimping the ends of filled coin wrappers. The improved device should be inexpensive, easy to use and not require maintenance.

SUMMARY OF THE INVENTION

The invention is an improved crimper for forming finished crimped ends on coin wrappers. The crimper has no moving parts and is inexpensive to manufacture. It is easy to use and requires no maintenance. The crimper makes it feasible for the individual coin collector to store coins in coin wrappers having finished crimped ends on both ends of the wrappers.

A crimper in accordance with the present invention has a body having a cylindrical opening for receiving a projecting end of a wrapper into the body. The opening extending along an axis from an open end and is defined by a wall configured to closely surround the outer surface of a projecting end of a wrapper.

A crimping structure is located in the opening for crimping the projecting end of the wrapper inserted into the opening. The crimping structure includes a first slide surface for sliding the wrapper of the paper in a first linear direction and a second slide surface for sliding the wrapper paper in a second linear direction transverse to the first direction. The first slide surface is spaced axially from the open end of the opening and extends from the opening wall into the opening towards the second slide surface. The second slide surface is adjacent the first slide surface and extends axially away from the first slide surface towards the open end of the opening.

When the first slide surface is pressed against the end of the wrapper, the end of the wrapper is forced to slide against the first slide surface to the second slide surface. The end of the wrapper then slides axially against the second slide surface towards the open end of the opening. Because the two slide surfaces are substantially perpendicular to each other, the end of the wrapper is forced to roll towards the coin stack and thereby form a rolled crimped end on the wrapper. The crimper is rotated about the axis when pressing the first slide surface against the end of the wrapper to form a crimped end extending around the entire circumference of the wrapper.

In preferred embodiments of the invention, the crimping structure includes two or more first slide surfaces angularly spaced apart from one another. Each first slide surface is a convex surface. The second slide surface is also a convex surface and forms part of an outer wall of a cylindrical projection in the opening.

When the first slide surfaces are pressed against the projecting end of the coin wrapper, the convex surfaces of the first and second slide surfaces in effect make line contact with the wrapper paper. This concentrates the force applied by the slide surfaces against the wrapper paper and causes the paper to deform and roll more easily. The spaced apart first slide surfaces enable the entire circumference of the end of the wrapper to engage a first slide surface multiple times with each rotation of the crimper to form a very smooth finished crimped end. The projection engages the coin stack when the first slide surfaces are near the coin stack to ensure that the newly crimped end of the wrapper is rolled firmly against the coin stack to secure the coins in the wrapper.

The linear slide surfaces are inexpensive to manufacture. The crimper can be formed as an integral, homogeneous, one piece plastic article using conventional molding techniques. Such a crimper is compact and light weight. The body can have a plurality of faces, each face having an opening and associated crimping structure for crimping different denominations of coin wrappers. For example, the body can be formed as a cube having six faces and openings for one dollar, half-dollar, quarter, dime, nickel and penny coin wrappers.

Other objects and features of the invention will become apparent as the description proceeds, especially when taken in conjunction with the accompanying drawings illustrating the invention, of which there are three sheets of drawings and three embodiments.

DESCRIPTION OF THE PREFERRED EMBODIMENT

Figure 3:
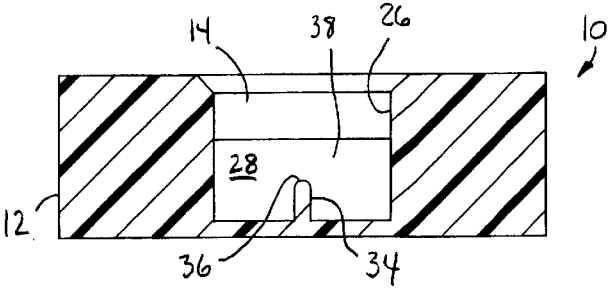
FIG. 3 is a sectional view of the crimper shown in FIG. 1 taken along line 3—3 of FIG. 1.
Figure 1:
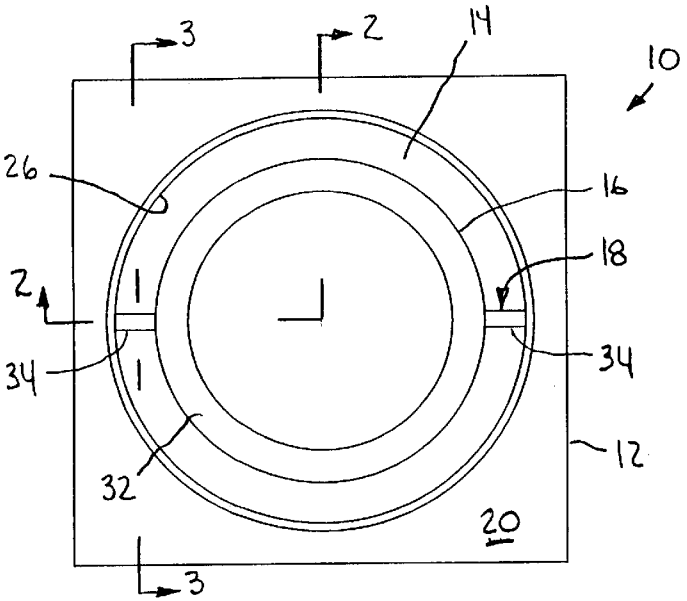
FIG. 1 is a top view of a manual coin wrapper crimper of the present invention.
Figure 2:
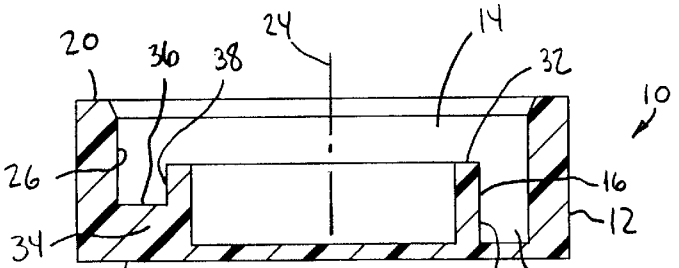
FIG. 2 is a sectional view of the crimper shown in FIG. 1 taken along line 2—2 of FIG. 1.

FIGS. 1–3 illustrate a first embodiment manual crimper 10 in accordance with the present invention. The crimper 10 is formed as an integral, one piece plastic member using conventional plastic molding techniques and includes a body 12 having an opening 14 for receiving a projecting end of a coin wrapper for holding a specific denomination of coins. A projection 16 and crimping structure 18 are located in the opening.

The body has a first surface or face 20 and an opposite second face 22 separated by the thickness of the body. The opening is cylindrical and extends partially through the thickness of the body 12 along a central axis 24 from an open end at the first surface to a bottom end in the body. An interior circumferential wall 26 surrounds the opening and has a diameter slightly larger than the diameter of the specified coin wrapper.

The projection 16 is a tubular member that is concentric with the central axis and extends along the axis 24 from the bottom of the opening 14 partway to the open end of the opening 14. The outer wall 28 of the projection has a diameter less than the inside diameter of the coin wrapper. The outer projection wall 28 and the opening wall 26 define an annular space 30 between them. An annular surface 32 is located on the free end of the projection and faces the open end of the opening. Indicia (not shown) indicating the denomination of coins intended to be wrapped using the crimper can preferably be placed on the body face or on the bottom of the opening in the interior of the tubular member.

The crimping structure 18 includes a pair of like, diametrically opposed slide members 34 that extend radially from the opening wall 26 to the projection 16. Each slide member 34 extends axially from the bottom of the opening 14 partway to the free end 32 of the projection. A convex first slide surface 36 is located on the end of each slide member facing the open end of the opening. See FIG. 3. The slide surfaces 36 extend from the opening wall 26 to the outer wall 28 of the projection and each slide surface 36 defines a radial line of sliding. A second slide surface 38 forms the portion of the outer wall 28 of the projection 16 extending from the slide members 34 to the free end of the projection. The second slide surface 38 is also a convex surface and is perpendicular to the first slide surfaces and defines an axial line of sliding.

Figure 4:
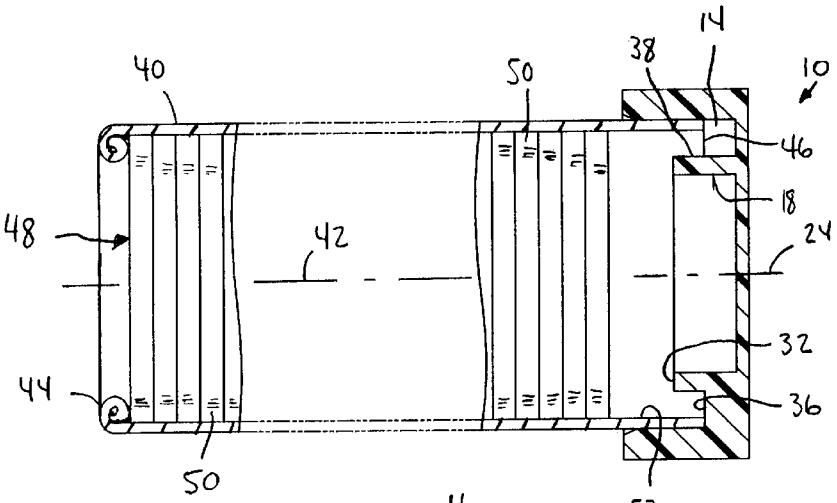
FIG. 4 is similar to FIG. 2 but includes the projecting end of a filled coin wrapper inserted into the crimper prior to crimping the end of the wrapper.
Figure 5:
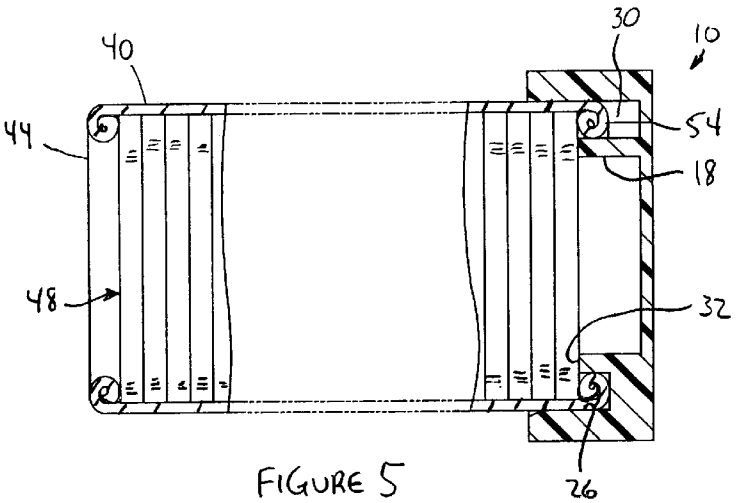
FIG. 5 is similar to FIG. 4 with the end of the wrapper crimped by the crimper.
Figure 9:
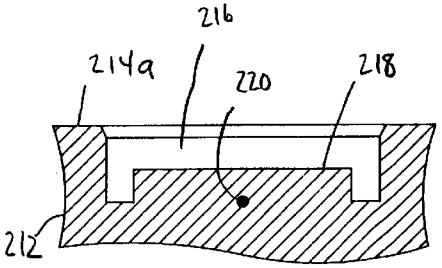
FIG. 9 is a partial sectional view taken along line 9—9 of FIG. 7.
Figure 7:
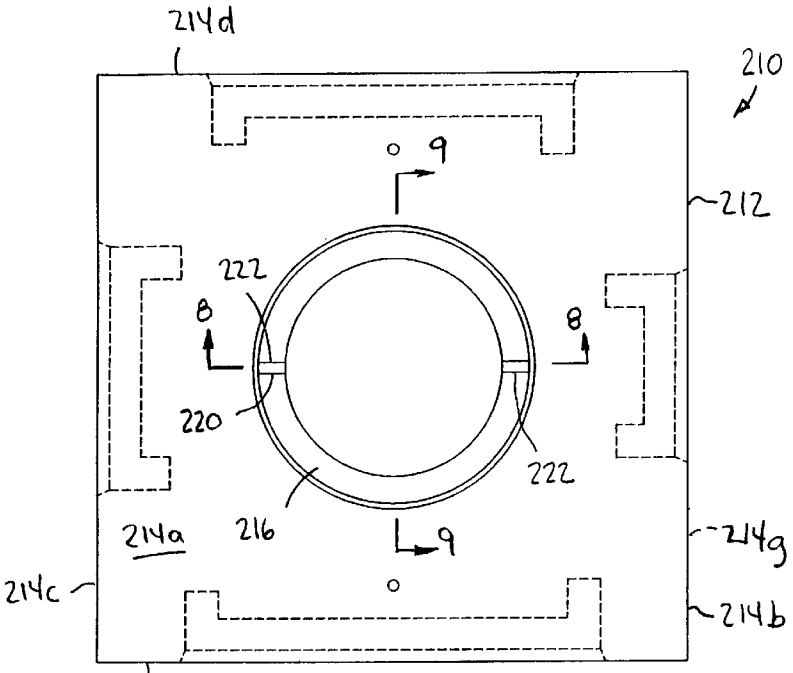
FIG. 7 is a front view of a third embodiment coin wrapper crimper in accordance with the present invention.
Figure 8:
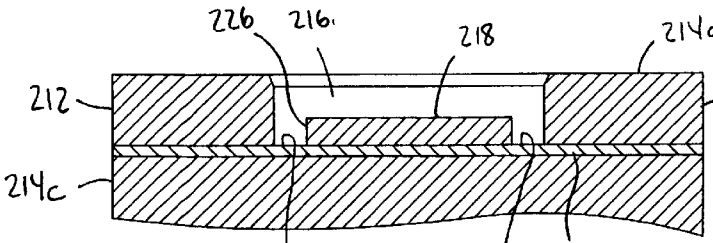
FIG. 8 is a partial sectional view of the crimper shown in FIG. 7 taken along line 8—8 of FIG. 7.

FIGS. 4 and 5 illustrate operation of the crimper 10 in crimping the projecting end of a filled, conventional coin wrapper 40. The coin wrapper is formed from relatively stiff paper and is an elongate tube that extends along an axis 42. The wrapper has a premanufactured crimped end 44 and a non-crimped open end 46. A coin stack 48 of individual coins 50 fills the wrapper and abuts and is supported against the crimped end of the wrapper. The projecting end 52 of the coin wrapper extends from the coin stack to the open end of the wrapper.

To form a finished crimped end on the projecting end of the coin wrapper, the end 46 of the coin wrapper is inserted into the opening 14. The open end of the opening 14 is chamfered as best shown in FIG. 2 to receive the end of the coin wrapper and guide it into the opening. The coin wrapper moves into the annular space 30 and surrounds the projection 16 until the end of the wrapper engages and presses against the first slide. surfaces 36. See FIG. 4. At this point the wrapper is substantially coaxial with the axis of the opening. The annular surface 32 at the end of the projection faces and is spaced from the coin stack.

The crimper 10 is then pressed against the coin wrapper 40 to press the first slide surfaces 36 against the projecting end of the coin wrapper. The convex surfaces of the first slide surfaces 36 in effect make line contact with the wrapper paper and force the paper to buckle and slide on the first slide surfaces 36 in a radial slide direction towards the projection. As the crimper is pressed against the coin wrapper, the paper engages the projection 16 and slides on the second slide surface 38 in an axial slide direction towards the open end of the opening 14. By forcing the paper to slide radially and then slide axially, the projecting end of the wrapper is caused to roll over and form a rolled crimped end.

The crimper 10 is also rotated about the axis 24 with respect to the coin wrapper while being pressed against the end of the coin wrapper. This enables the first slide surfaces 36 to engage the entire circumference of the wrapper and form a roll around the complete circumference of the wrapper. The two first slide surfaces 36 are located 180 degrees apart so that in each 180 degrees of rotation the entire circumference of the wrapper end 46 engages a first slide surface. In other embodiments, additional first slide surfaces may be provided so that even less rotation is required for the circumference to engage a first slide surface. The crimper can be rotated in one direction or back and forth in both directions as desired.

As the slide surfaces 36 continue to be pressed against the projecting end of the wrapper, the crimper advances axially toward the coin stack until the projection 16 engages the coin stack 48. See FIG. 5. At this point the projecting end of the wrapper is tightly rolled in the annular space between the projection 16 and the opening wall 26 as shown in FIG. 5 to form the finished crimp end 54.

The projection 16 engages the coin stack 48 when the first sliding surfaces 36 are near the coin stack to ensure that the newly crimped end of the wrapper is rolled firmly against the coin stack to secure the coins in the wrapper. The annular surface 32 at the free end of the projection acts as a stop to limit the axial movement of the first slide surfaces 36 and prevent crushing of the newly crimped end 54 by the first slide surfaces. The finished coin wrapper is then removed from the crimper with the newly crimped end remaining firmly rolled against the coin stack.

Depending on the length of the projection end and the stiffness of the wrapper paper, the projecting end of the wrapper can be rolled over itself several times to form the finished rolled crimped end. This enables the crimper to form finished rolled crimps despite tolerances in the thickness of the individual coins or if less than the standard number of coins make up the coin stack. For example, tests with the crimper 10 in crimping wrappers for quarters which are intended to hold 40 quarters formed satisfactory crimped ends with a coin stack of only 36 quarters.

Figure 6:
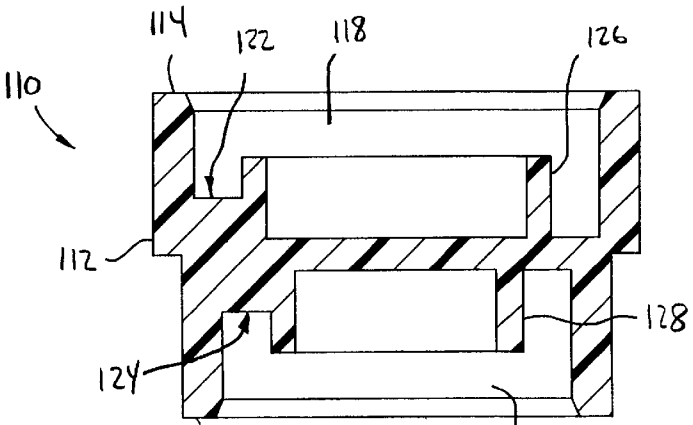
FIG. 6 is a sectional view similar to FIG. 2 but of a second embodiment coin wrapper crimper in accordance with the present invention.

FIG. 6 is similar to FIG. 2 but illustrates a similar cross-sectional view of a second embodiment crimper 110 in accordance with the present invention. The crimper 110 is also formed as an integral, one piece plastic member using conventional. plastic molding techniques. The crimper includes a body 112 having opposed first and second faces 114 and 116, and each face has an opening 118 and 120 for receiving a projecting end of a coin wrapper. Each opening 118 and 120 is sized to receive a coin wrapper of a different denomination coin than the other opening. Crimping structure 122 and 124 and projections 126 and 128 are located in each opening, each similar to the crimping structure and projection in the crimper 10. In effect, the crimper 110 consists of two differently sized crimpers 10 joined back to back to enable crimping two sizes of coin wrapper with the same crimper.

FIGS. 7–10 illustrate a third embodiment crimper 210 in accordance with the present invention. The crimper 210 has a body 212 formed as a cube having six outer faces 214*a*–214*g*. The body 212 is machined from a block of aluminum. Each face 214 includes an opening 216 sized to receive a coin wrapper for a different denomination of coin from the other openings. Cylindrical projections 218 extend from the bottom of the openings. Indicia (not shown) indicating the denomination of coins intended to be wrapped using a particular opening of the crimper can preferably be placed on the body face or on the free end of the projection associated with the opening.

Elongate cylindrical pins or shafts 220 extend diametrically through the openings at the bottom of the openings. Each pin 220 extends through its associated projection to form two radial slide portions 222 that extend from the opening wall to the projection 218. The surface 224 of each slide portion facing the open end of the opening forms the convex first slide surfaces, similar to the convex slide surfaces 36 of the crimper 10. The outer wall 226 of the projection 218 extending from the pin 220 to the free end of the projection forms the second slide surface, similar to the second slide surface 38 of the crimper 10. Operation of the crimper 210 is similar to the crimper 10.

In this embodiment the individual pins 220 extend from one transverse face to the opposite transverse face for easy insertion of the pins. In other embodiments the pins can be molded in the body.

While I have illustrated and described preferred embodiments of my invention, it is understood that this is capable of modification, and I therefore do not wish to be limited to the precise details set forth, but desire to avail myself of such changes and alterations as fall within the purview of the following claims.

What I claim as my invention:

1. A crimper for manually crimping a projecting end of a coin wrapper containing a coin stack, the crimper comprising:

a body having an opening for receiving a projecting end of a coin wrapper, the opening extending along an axis into the body from an open first end to a second end, the opening being surrounded by a circumferential wall configured to closely surround an outer surface of a projecting end of a wrapper;

a projection extending into the opening from the second end of the opening to a free end located partway to the first end of the opening, the projection having an outer wall facing the opening wall, the outer wall and the opening wall defining an annular space between them; and a slide member extending radially from the circumferential wall opening to the projection, the slide member having a slide surface spaced axially from the free end of the projection and from the second end of the opening and defining a first linear direction of sliding, whereby when a projecting end of a coin wrapper is pressed against the slide member the projecting end of the coin wrapper slides in the first direction against the slide surface to the outer wall of the projection and slides axially against the outer wall towards the first end of the opening substantially transverse to the first direction of sliding to thereby form a rolled crimped end on the wrapper.

2. A crimper as in claim 1 wherein the first slide surface is a convex surface.

3. A crimper as in claim 1 further including one or more additional first slide surfaces.

4. A crimper as in claim 1 wherein the free end of the projection is a stop to limit relative axial movement of the first slide surface towards a coin stack when a crimped end is being formed on the a projecting end of a coin wrapper.

5. A crimper as in claim 1 wherein the crimper is formed as an integral one-piece article.

6. A crimper as in claim 1 including a plurality of openings and crimping structures, each crimping structure associated with an opening, wherein the openings are each sized for a differently sized wrapper.

7. A crimper as in claim 1 further including an elongate pin having an outer surface, the first sliding surface located on at least a portion of the outer surface of the pin.

8. A crimper for crimping a projecting end of a wrapper, the crimper comprising:

a body having an opening for receiving a projecting end of a wrapper into the body, the opening extending along an axis from an open end to a second end and defined by a first circumferential wall configured to closely surround an outer surface of a projecting end of a wrapper;

a crimping structure in the opening for crimping a projecting end of a wrapper received in the opening, the crimping structure including a non-concave first slide surface and a second slide surface; and the first slide surface spaced axially from the open end and from the second end of the opening and extending from the circumferential wall into the opening towards the second slide surface, the second slide surface adjacent the first slide surface and extending axially away from the first slide surface towards the open end of the opening;

whereby when the first slide surface is pressed against a projecting end of a wrapper the projecting end of the wrapper is forced to slide against the first slide surface to the second slide surface and slide against the second slide surface to thereby form a rolled crimped end on the wrapper.

9. A crimper as in claim 8 wherein the first slide surface extends perpendicularly to the axis of the opening.

10. A crimper as in claim 8 wherein the first slide surface is a convex surface.

11. A crimper as in claim 8 wherein the second slide surface is a convex surface.

12. A crimper as in claim 11 wherein the second slide surface surrounds the axis.

13. A crimper as in claim 12 wherein the crimping structure includes a plurality of first slide surfaces.

14. A crimper as in claim 8 including a stop surface in the hole in the path of movement of an article stack contained in a wrapper to limit relative axial movement of the first slide surface towards the stack of articles.

15. A crimper as in claim 14 wherein the second slide surface extends from the first slide surface to the stop surface.

16. A crimper as in claim 8 wherein the crimper is formed as an integral one-piece article.

17. A crimper as in claim 8 including a plurality of openings and crimping structures, each crimping structure associated with an opening, wherein the openings are each sized for a differently sized wrapper.

* * * * *